US012233348B2

(12) United States Patent
Krys

(10) Patent No.: US 12,233,348 B2
(45) **Date of Patent: *Feb. 25, 2025**

(54) PUZZLE BOX

(71) Applicant: Alexander Krys, Meerbusch (DE)

(72) Inventor: Alexander Krys, Meerbusch (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/588,708

(22) Filed: Feb. 27, 2024

(65) Prior Publication Data

US 2024/0198210 A1 Jun. 20, 2024

Related U.S. Application Data

(63) Continuation of application No. 18/418,770, filed on Jan. 22, 2024.

(51) Int. Cl.
*A63F 9/12* (2006.01)

(52) U.S. Cl.
CPC ..... *A63F 9/12* (2013.01)

(58) Field of Classification Search
CPC ..... A63F 9/12; A63F 2250/24; A63F 9/10
See application file for complete search history.

(56) References Cited

U.S. PATENT DOCUMENTS 3,216,558 A * 11/1965 Marsh ..... A63F 9/12 273/153 S
4,934,701 A * 6/1990 Ting ..... A63F 9/12 273/157 R
5,351,957 A * 10/1994 Scott ..... A63F 9/1044 273/157 R
5,419,558 A * 5/1995 Jones ..... A63F 9/08 70/289
5,683,086 A * 11/1997 Druckman ..... A63F 9/12 273/156
6,276,684 B1 * 8/2001 Hershkovits ..... A63F 9/1288 273/156
9,238,170 B1 * 1/2016 Holmes ..... A63F 9/06
10,188,937 B1 * 1/2019 Whitney ..... A63F 9/0819
11,130,048 B2 * 9/2021 Singh ..... A63F 9/0811
D973,786 S * 12/2022 Krys ..... D21/478
11,612,807 B2 * 3/2023 Morris ..... A63F 9/0826 273/153 S
D994,786 S * 8/2023 Krys ..... D21/478
D1,013,057 S * 1/2024 Krys ..... D21/478
D1,013,058 S * 1/2024 Krys ..... D21/478
2022/0323853 A1 * 10/2022 Wu ..... A63F 9/0826
2024/0091631 A1 * 3/2024 Litwin ..... B42D 15/022

FOREIGN PATENT DOCUMENTS

WO WO-2019048814 A1 * 3/2019 ..... A63F 9/06

* cited by examiner

*Primary Examiner* — Steven B Wong
(74) *Attorney, Agent, or Firm* — Maier & Maier, PLLC

(57) ABSTRACT

A puzzle box. The puzzle box includes an assemblable puzzle having at least one puzzle piece, and at least one movable element movable between an initial position and a subsequent position. A configuration of the puzzle pieces of the assemblable puzzle provides an inducement for a movement of the movable element into the subsequent position.

19 Claims, 13 Drawing Sheets

PUZZLE BOX

CROSS-REFERENCE TO RELATED APPLICATIONS

This application is a continuation of to U.S. patent application Ser. No. 18/418,770, filed Jan. 22, 2024, and entitled Puzzle Box, the entire contents of which are hereby incorporated by reference.

BACKGROUND

Embodiments disclosed herein are directed towards a puzzle box having an assemblable puzzle having a plurality of puzzle pieces, and further having movable elements. The arrangement of the puzzle pieces can provide an inducement for moving the movable elements so as to achieve one or more goals or solutions of the puzzle box.

SUMMARY

According to at least one exemplary embodiment, a puzzle box is disclosed. The puzzle box can include an assemblable puzzle having at least one puzzle piece, and at least one movable element movable between an initial position and a subsequent position. A configuration of the puzzle pieces of the assemblable puzzle can provide an inducement for a movement of the movable element into the subsequent position.

The configuration may be a solved configuration of the assemblable puzzle. A goal of the puzzle box may be achieved by the movement of the at least one movable element into the subsequent position. The inducement may be one or more of a manual inducement and an automatic inducement and may include one or more of a physical link between the puzzle piece and the movable element and a logical link between the puzzle piece and the movable element. The puzzle box can further include at least one additional movable element, wherein the movement of the movable element into the subsequent position can provide an additional inducement for a movement of the additional movable element into a subsequent position of the additional movable element.

According to another exemplary embodiment, a puzzle box is disclosed. The puzzle box can include a frame having a base for puzzle assembly, a puzzle comprising at least one puzzle piece and assemblable on the base, and a movable element disposed in movable relation to the frame. A solved configuration of the puzzle provides an inducement for a movement of the movable element from an initial position to a final position. The base may include a single surface, or may include at least two surfaces, a first surface of the surfaces being disposed above a second surface of the surfaces.

The inducement may be one or more of a manual inducement and an automatic inducement and may be executed by a user or without additional action by the user. The inducement may provide information to a user regarding the movement of the movable element from the initial position. The movement of the movable element may be executed due to a movement of an additional movable element from an initial position of the additional movable element. The movement of the movable element may be carried out due to a physical or magnetic interaction between the movable element and the puzzle piece, or due to a physical or magnetic interaction between the movable element and an additional movable element.

The movable element can further include one or more of a visible portion and a concealed portion, the visible portion being disposed in relation to the frame so as to be visible to a user, and the concealed portion being disposed beneath a surface of the frame so as to not be visible to the user. The visible portion and the concealed portion may be connected via an aperture in the frame. In the solved configuration of the puzzle, the puzzle pieces may define a window, and at least a portion of the visible portion of the movable element may be visible through the window. Furthermore, said portion of the visible portion may be disposed within the window, and an outer perimeter of said portion is sized and shaped to complement an inner perimeter of the window.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Figure 1A:
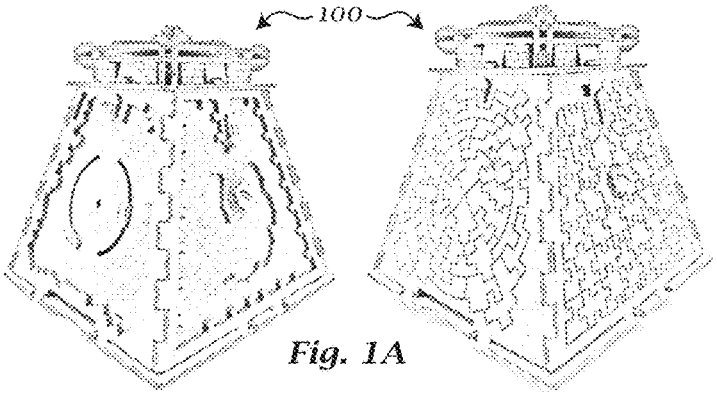
FIGS. 1A-1E show exemplary embodiments of puzzle boxes.

Aspects of the invention are disclosed in the following description and related drawings directed to specific embodiments of the invention. Those skilled in the art will recognize that alternate embodiments may be devised without departing from the scope of the claims. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

According to at least one exemplary embodiment, a puzzle box is disclosed. The puzzle box can include at least one assemblable puzzle, for example a jigsaw puzzle, or any other type of puzzle that enables the puzzle box to function as described herein, and at least one movable element that is movable between at least between an initial position and a subsequent position. The subsequent position may be a final position, or may be at least one intermediate position between the initial position and a final position. A goal may be achieved by solving the assemblable puzzle, moving the movable element to the final position or a combination of both; or, a step towards achieving the goal may be taken by solving the assemblable puzzle, moving the movable element to the subsequent position, or a combination of both.

The assemblable puzzle can include a plurality of puzzle pieces. The puzzle pieces may be assembled into a solved configuration. The solved configuration of the puzzle pieces may provide an inducement for moving the movable element into an intermediate position or into the final position. An inducement may include one or more of an action, movement, trigger, clue, hint, suggestion, information, and so forth, that results in a movement of the movable element. An inducement may be manual (i.e., triggered by the player when the puzzle pieces are in the solved configuration), automatic (i.e., triggered by the puzzle pieces or a positioning of the puzzle pieces when the puzzle pieces are assembled into the solved configuration) or a combination of automatic and manual inducements. An inducement may include a physical link between one or more of the puzzle pieces and at least one movable element, a logical link between one or more of the puzzle pieces and at least one movable element, or one or more combinations of the physical link and the logical link.

The physical link between one or more of the puzzle pieces and at least one movable element may be, for example, a physical connection, a magnetic connection, or any other connection such that a movement or positioning of one or more puzzle pieces allows or results in a movement of at least one movable element. For example, a positioning of a puzzle piece into a position according to the solved configuration can allow or result in a movement of a movable element that is connected to, touching, abutting, or otherwise in physical interaction with the puzzle piece. As another example, a positioning of a puzzle piece into a position according to the solved configuration can allow or result in a movement of a movable element that may be in magnetic interaction with the puzzle piece. Combinations or variations of these examples may further be contemplated and provided as desired.

The logical link between one or more of the puzzle pieces and at least one movable element may be, for example, information provided to the user via one or more puzzle pieces regarding one or more steps to be taken so as to result in a movement of the movable element. In other words, a logical link may include a clue or a hint as to how to move or position the movable element. For example, a positioning of a puzzle piece into a position according to the solved configuration can provide visual information to the user as to an intermediate position or final position of a movable element. As another example, a positioning of a puzzle piece into a position according to the solved configuration can reveal to the user, or provide the user with access to, or unblock, additional puzzle pieces or movable elements, interaction with which may be necessary to position a desired movable element into an intermediate position or final position. As another example, due to a positioning of a puzzle piece into a position according to the solved configuration, a movable element that was previously blocked in position may be unblocked and free to move. As another example, a positioning of a puzzle piece into a position according to the solved configuration can reveal to the user, or provide the user with access to, or unblock, previously hidden or blocked components that include information, such as visual information, as to further actions necessary to achieve a goal. Combinations or variations of these examples may further be contemplated and provided as desired.

The puzzle box can include one goal or multiple goals. Achieving a goal may include one or more of the assemblable puzzle being in the solved configuration, and the associated movable elements being in an intermediate position or the final position. Moving a movable element, or a plurality of movable elements, into their final positions can result in achievement of at least one goal of the puzzle box. In embodiments where multiple goals are present, goals may be achieved independently of each other, may be achieved sequentially, or a combination of both. For example, in a puzzle box having multiple goals, the one or more goals may be achieved independently from the other goals of the puzzle box. As another example, in a puzzle box having multiple goals, the one or more goals may be achieved sequentially, i.e., the goals may be required to be achieved in a particular order, with certain of the goals being achieved prior to others of the goals being achieved. In some embodiments, achieving one or more of the goals may provide the user with instructions, hints, or clues as to how to achieve remaining goals. Achieving all goals of the puzzle box may result in achieving the final goal of the puzzle box, for example, having all goals of the puzzle box solved.

Figure 1B:
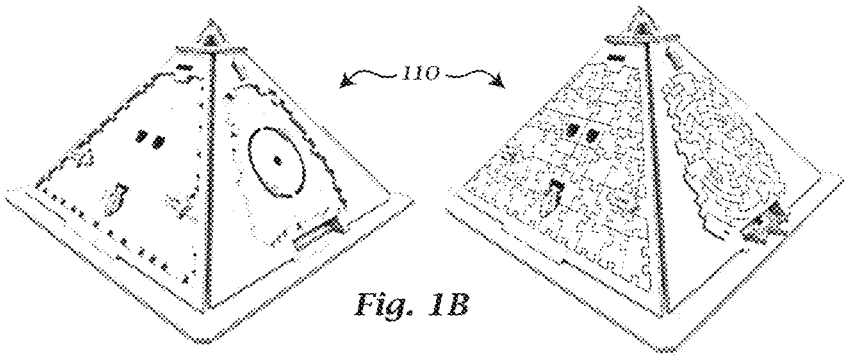
Figure 1C:
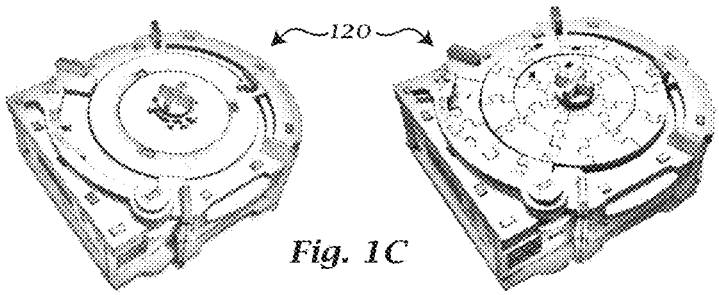
Figure 1D:
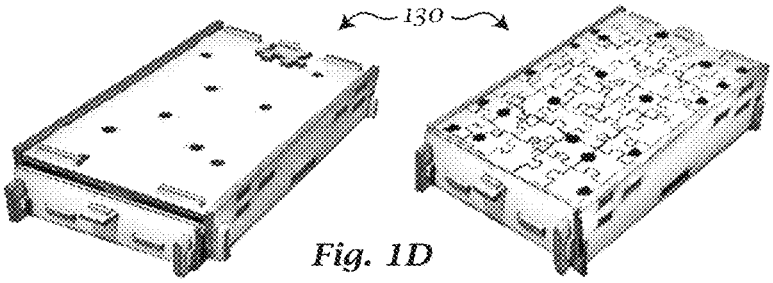
Figure 1E:
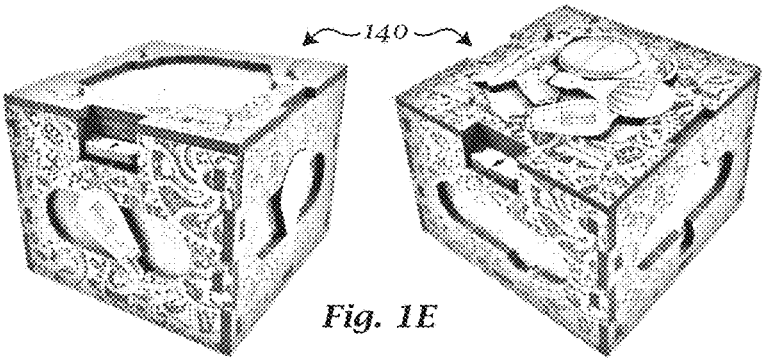

Exemplary embodiments of the puzzle box may be provided in various shapes and configurations. For example, a puzzle box 100 may have a frustopyramidal shape shown in FIG. 1A, a puzzle box 110 may have a pyramidal shape as shown in FIG. 1B, a puzzle box 120 may have a cylindrical or rectangular-prismatic/cylindrical shape as shown in FIG. 1C, a puzzle box 130 may have a rectangular prismatic shape as shown in FIG. 1D, or a puzzle box 140 may have a cubic shape as shown in FIG. 1E. It should be appreciated that the shape of the puzzle box is not limited to the embodiments disclosed herein, and any shape that enables the puzzle box to function as described herein may be contemplated and provided as desired.

Figure 2A:
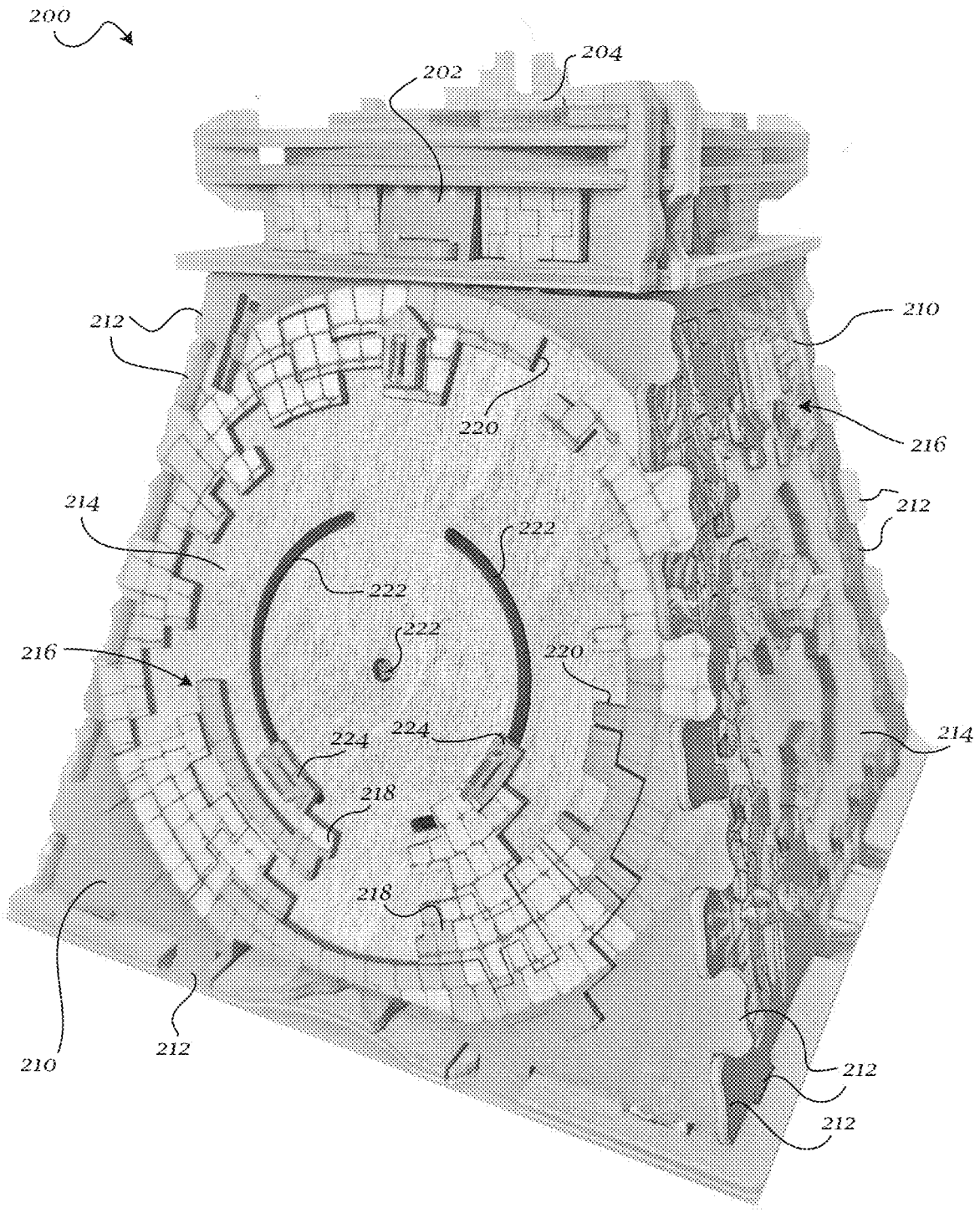
FIGS. 2A-2B show another exemplary embodiment of a puzzle box.
Figure 2B:
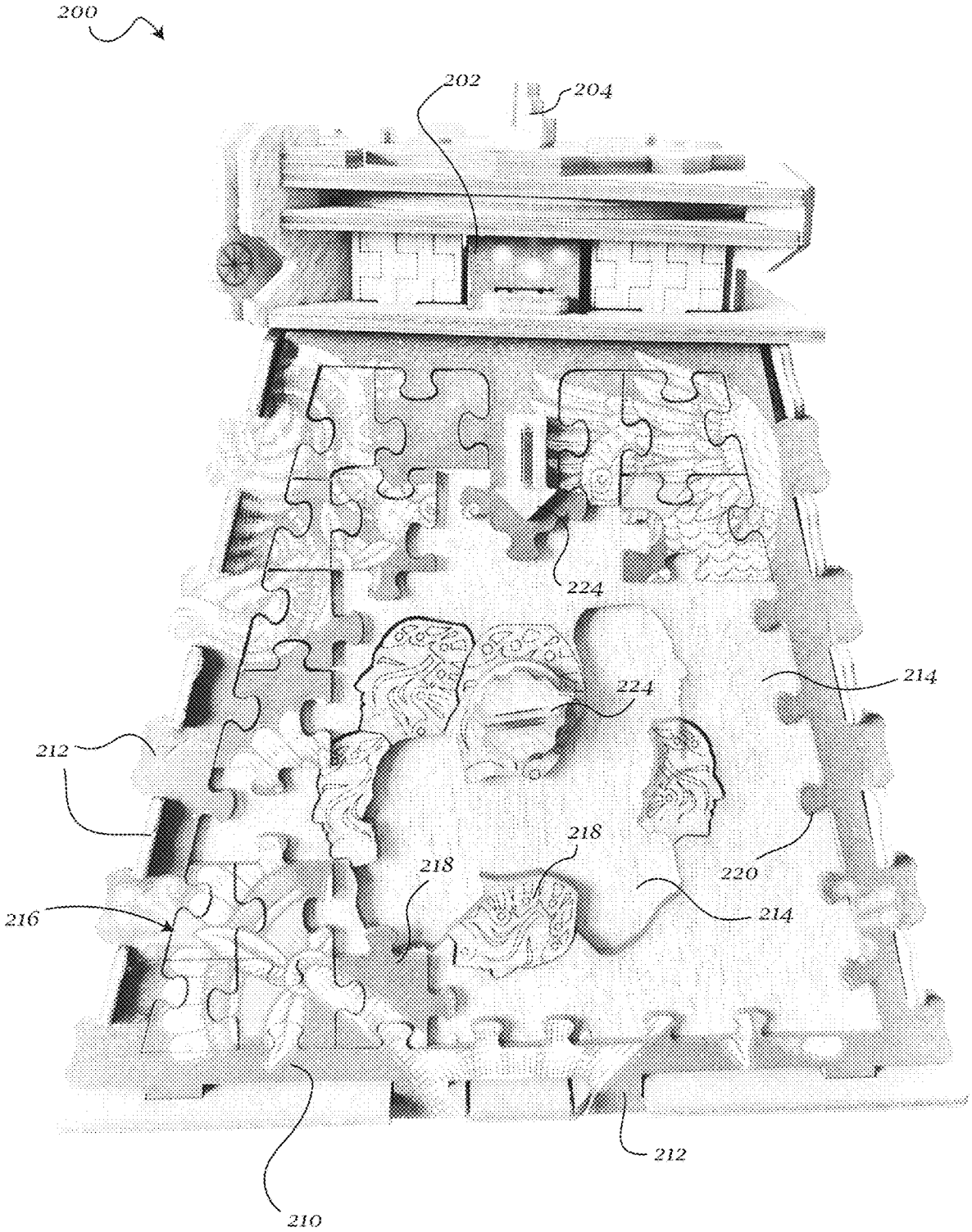

FIGS. 2A and 2B show views of an exemplary embodiment of a puzzle box 200. Embodiments of the puzzle box may include one or more frames 210. A plurality of frames 210 may enclose an interior of puzzle box 200. In some embodiments, frames 210 may function as structural components of puzzle box 200. In some embodiments, one or more frames 210 may be fixed to puzzle box 200 (for example, to other structural components of the puzzle box) so as to be non-detachable from puzzle box 200. In other embodiments, one or more frames 210 may be detachable from puzzle box 200. Detachable frames may be interchangeable with other detachable frames. For example, a different assemblable puzzle may be provided on each frame of a plurality of interchangeable frames. The different assemblable puzzles can have diverse images displayed thereon, diverse shapes and arrangements of puzzle pieces, and so forth. Such detachability and interchangeability can allow the user to interact with various assemblable puzzles as desired. Furthermore, detachable frames may include mounting elements 212 which may interact with complementary mounting elements 212 of adjacent frames 210, or with other structural elements of the puzzle box, so as to fix in place the detachable frame on the puzzle box.

An underlying base 214 of a frame 210 can provide a surface for assembly of the various puzzle pieces 218 of an assemblable puzzle 216. In other words, the puzzle pieces may be laid on the surface of the underlying base to assemble the puzzle. The pieces may further be in interaction with one or more internal edges 220 of the frame, on which may be disposed guidance elements for appropriate positioning of the puzzle pieces on the underlying base. Such guidance elements may include, for example, edge contours that are sized and shaped to complement the contours of corresponding puzzle pieces that are to be positioned adjacent the frame edge in the solved configuration of the puzzle.

In some exemplary embodiments, as shown in FIG. 2B, an underlying base 214 may include several levels; i.e., a plurality of surfaces disposed above or beneath each other. This can allow certain puzzle pieces 218 of an assemblable puzzle 216 to be positioned on the various surfaces of the underlying base, and above or beneath other puzzle pieces of the assemblable puzzle. The certain puzzle pieces that are positioned beneath other puzzle pieces can further provide a surface for assembly of the other puzzle pieces that are positioned above the certain puzzle pieces. Such surface may be flush with a surface of the underlying base so as to provide a continuous surface for positioning of the other puzzle pieces.

As used herein, the term "above" should be understood as extending in a direction away from the interior of the puzzle box with respect to the plane of the surface of the respective underlying base, and the term "beneath" should be understood as extending in a direction toward the interior of the puzzle box with respect to the plane of the surface of the respective underlying base.

Underlying base 214 can further include apertures 222, such as holes, slots, slits, grooves, channels, and other such elements in which, or through which, portions of various movable elements 224 may be disposed. A movable element 224 may include one or both of one or more visible portions and one or more concealed portions, as discussed further below. The visible portions may be portions of the movable elements that are visible to the user from above or through the underlying base, and can include structures with which the user is able to interact. The concealed portions may be portions of the movable elements that are concealed beneath the underlying base, and can include structures that interact with portions of other movable elements beneath the underlying base.

Parts of the visible portions of the movable elements may further be flush with the surface of the respective underlying base so as to provide a continuous surface for positioning of the puzzle pieces. Other parts of the visible portions of the movable elements may protrude above or be recessed beneath the surface or surfaces of the underlying base.

Movable elements 224 may be mounted in the interior of puzzle box 100, beneath the surface or surfaces of the underlying base of the respective frame. The movable elements 224 may be mounted to the puzzle box 100, may be mounted to the corresponding frame, or a combination of both.

An assemblable puzzle 216 may include a plurality of puzzle pieces 218 which may interlock with each other (i.e., as a jigsaw puzzle), or which may otherwise fit together so as to form the solved configuration when the puzzle is assembled. The user may be provided with various guidances or hints as to how to assemble the puzzle. For example, a puzzle may be assembled by way of visual guidance from an image depicted on the constituent puzzle pieces, or by way of physical guidance from the edge contours of the interlocking puzzle pieces and the guidance elements of the frame. Furthermore, guidance may also be provided by way of a solution to one or more logical riddles provided on other elements of the puzzle box. As an example, a puzzle may include several puzzle pieces having a same shape and/or visual appearance, and the correct arrangement of the pieces may be based on information located on a different assemblable puzzle of the puzzle box, one or more movable elements of the puzzle box, another structure or element of the puzzle box, or a combination of any or all of the aforementioned. Additional puzzles or riddles 202 as well as movable elements 204 may also be provided on puzzle box 200 outside a frame 212.

The components of a puzzle box may be created from various materials, such as wood, paper, plastic, metal, glass, or any desired material or combination of materials that enables the puzzle box to function as described herein.

Further exemplary embodiments of puzzle boxes and/or components thereof will now be described. Such embodiments are described for the purpose of illustrating exemplary embodiments of frames, puzzles, and movable elements that may be used as part of a puzzle box, as well as exemplary interactions therebetween. It should be appreciated that such embodiments should not be construed as limiting, and that numerous variations and combinations thereof that enable the puzzle box to function as disclosed herein may be contemplated and provided as desired. The above-described features and functions are not limited to the embodiments of FIGS. 1A-2B but may also be applicable to the further embodiments described below.

FIGS. 3A-3E show an exemplary embodiment of a puzzle box 300 having a frame 310 with an underlying base 314, and a plurality of apertures 3221, 3222, 3223 for the visible portions 3261, 3262, 3263 of respective movable elements 3241, 3242, 3243. An assemblable puzzle 316 having a plurality of puzzle pieces 318 may be assembled on the surface of underlying base 314. Movable elements 3241, 3242 may be rotatable, while movable element 3243 may be translatable.

Figure 3A:
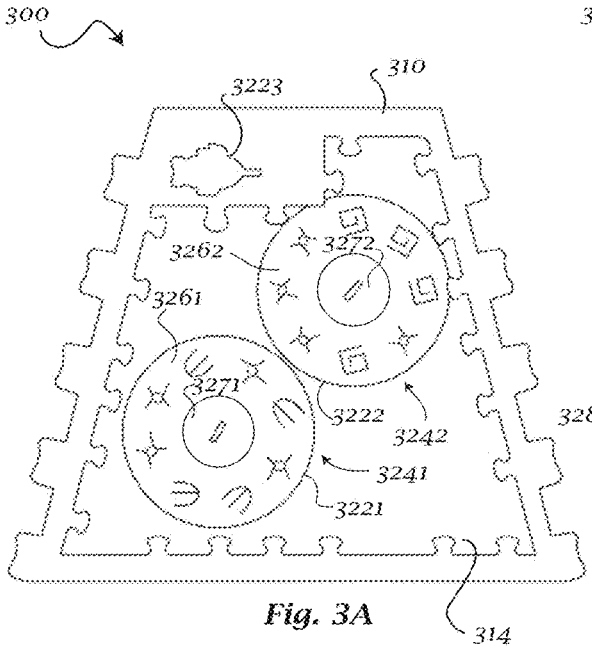
FIGS. 3A-3E show another exemplary embodiment of a puzzle box.

As shown in FIG. 3A, when no puzzle pieces are placed on underlying base 314, movable elements 3241, 3242 present to the user with first visible portions 3261, 3262 and second visible portions 3271, 3272, the first and second visible portions being disposed concentric to each other, respectively. The surface of first visible portions 3261, 3262 may be flush with the surface of underlying base 314, while the surface of second visible portions 3271, 3272 may protrude above the first visible portions. The first visible portions 3261, 3262 may include a plurality of indicia displayed thereon, while the second visible portions 3271, 3272 may include a slot into which a key may be inserted, or may be provided with a key in place of the slot, the key providing a grip for the user to rotate the respective movable element.

Movable element 3263 may be visible through an aperture 3223 defined in frame 310 and located outside the area of the underlying base 314 for placement of the puzzle pieces. As such, movable element 3263 may be visible regardless of the configuration of assemblable puzzle 316. Movable element 3263 may include a slot into which a key may be inserted, or may be provided with a key in place of the slot, the key providing a grip for the user to translate the movable element.

Frame 310 can include mounting elements 312 on its outer perimeter, for interacting with corresponding mounting elements of adjacent frames, and can also include guidance elements on its inner perimeter, which interact with complementary edge contours of corresponding puzzle pieces.

Figure 3B:
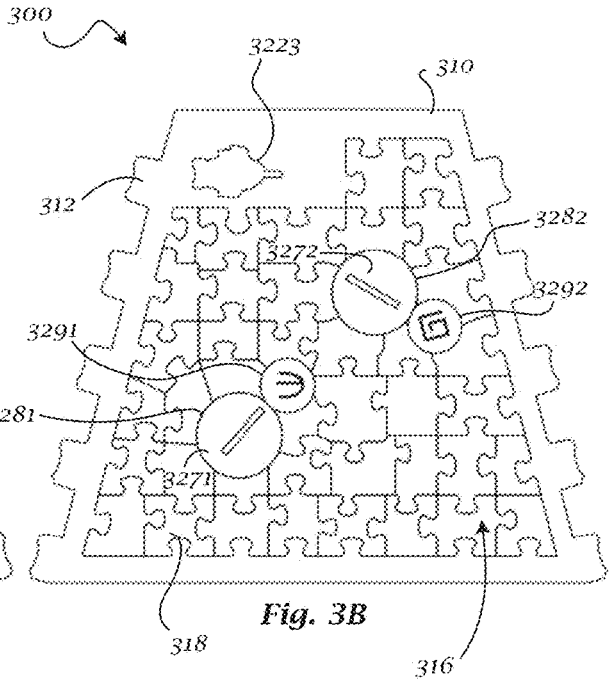

FIG. 3B shows the puzzle assembled into a solved configuration. In the solved configuration, a pair of first windows 3281, 3282 and a pair of second windows 3291, 3292 may be defined by the arrangement of the puzzle pieces. First windows 3281, 3282 may provide apertures for second visible portions 3271, 3272 of movable elements 3241, 3242, while second windows 3291, 3292 may provide apertures for one of the plurality of indicia displayed on the first visible portions 3261, 3262 of movable elements 3241, 3242. The surfaces of the second visible portions may be flush with the surface formed by puzzle pieces 318, or may protrude above the surface formed by puzzle pieces 318.

Figure 3C:
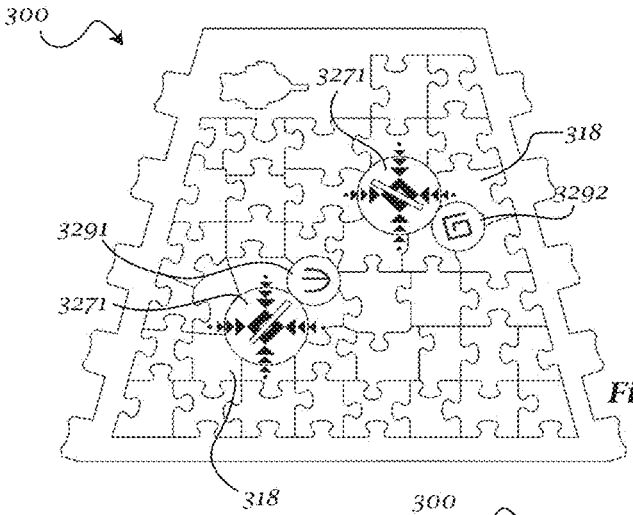

As can be seen in the solved configuration of puzzle box 300 in FIG. 3C, indicia provided on puzzle pieces 318 surrounding the second visible portions 3271, 3272 of movable elements 3241, 3242, can provide the user with hints towards achieving a goal of the puzzle or inducements for moving another movable element or elements. Aligning the indicia on the puzzle pieces with corresponding indicia on the second visible portions may provide the user with information regarding a final position of the movable elements. However, as may be seen in FIG. 3C, one of four positions may be the final position, and three of four positions may be merely intermediate positions, according to the symmetric visual indicia that are described above. Accordingly, the indicia that are visible via windows 3291, 3292 can provide further information regarding the correct orientation of movable elements 3241, 3242. The user can the rotate movable elements so as to change the indicia visible through windows 3291, 3292. The correct indicia to be displayed may be determined by solution of another puzzle of the puzzle box; i.e., the correct indicia may be obtained by achieving a goal, or one of the goals, of another puzzle of the puzzle box.

Figure 3D:
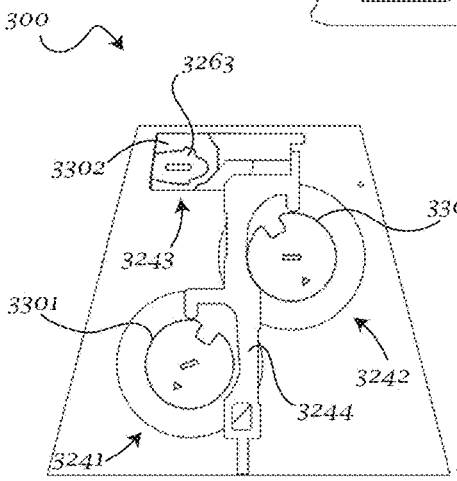
Figure 3E:
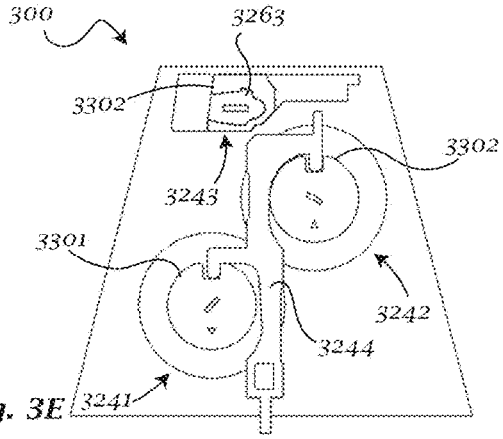

FIGS. 3D-3E show concealed portions 3301, 3302, 3303 of movable elements 3241, 3242, 3243 that are disposed beneath the underlying base 314 of frame 310. An additional movable element 3244, which has only a concealed portion and no visible portions, can also be seen. FIG. 3D shows an exemplary positioning of the movable elements when movable elements 3241, 3242 are not in the final position. In such a positioning, movable element 3244 is in an initial position, such that a tab of movable element 3244 blocks translation of movable element 3243 from its initial position. Conversely, as shown in FIG. 3E, when movable elements 3241, 3242 are in the final position, tabs of movable element 3244 can be disposed within slots defined in the concealed portions 3301, 3302 of movable elements 3241, 3242, resulting in an inducement of movable element 3244 to move into the final position. This, in turn, unblocks movable element 3243, allowing it to be moved from its initial position to its final position. Movement of element 3243 into its final position may be a goal, or one of the goals of the above-described puzzle, and may also provide information or inducements regarding other puzzles of the puzzle box.

In the embodiments described below, similar features to embodiment 300 are indicated with similar reference numerals, but with different leading digits corresponding to the leading digit of the respective embodiment. Elements that are not explicitly described may be the same as or substantially similar to elements having similar reference numerals of embodiment 300.

Figure 4A:
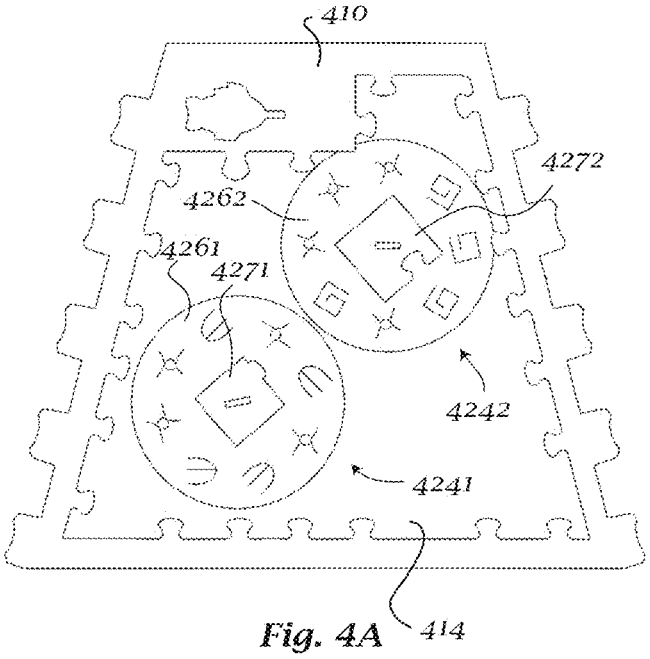
FIGS. 4A-4B show another exemplary embodiment of a puzzle box.
Figure 4B:
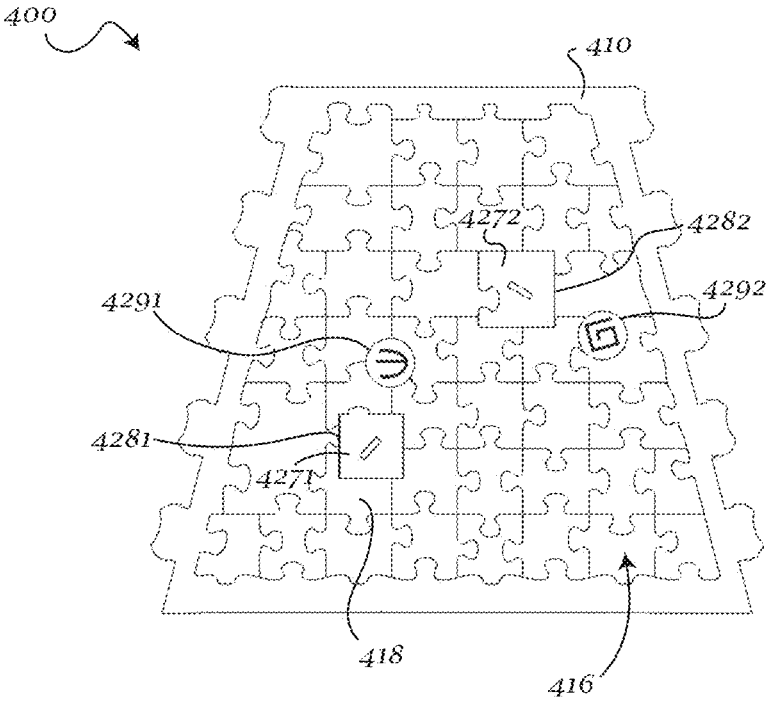

FIGS. 4A-4B show another exemplary embodiment of a puzzle box 400. In the embodiment of FIGS. 4A-4B, second visible portions 4271, 4272 of movable elements 4241, 4242 have a shape that complements corresponding edge contours of puzzle pieces 418 that surround second visible portions 4271, 4272. In other words, the second visible portions and windows 4281, 4282 have substantially similar shapes that allow only a specific orientation of the visible portions when the assemblable puzzle is in a solved configuration. Accordingly, the final positions of movable elements 4241, 4242 are determined by the orientation of second visible portions 4271, 4272 when the assemblable puzzle 416 is in a solved configuration.

When the movable elements 4241, 4242 are in their final orientations as determined by the correct orientations of second visible portions 4271, 4272, the indicia of first visible portions 4271, 4272 may be seen through windows 4291, 4292 defined by the puzzle pieces. Such indicia displayed in windows 4291, 4292 may be a goal, or one of the goals of the corresponding puzzle of the puzzle box. Furthermore, the indicia displayed when movable elements 4241, 4242 are in their final positions may serve as a hint, clue, or inducement with respect to another puzzle of the puzzle box. As a non-limiting example, the indicia displayed when movable elements 4241, 4242 are in their final positions can inform the user as to the correct indicia that should be displayed in the embodiment of puzzle box 300 described above.

FIGS. 5A-5D show another exemplary embodiment of a puzzle box 500. In the embodiment of FIGS. 5A-5D, three movable elements 5241, 5242, 5243 having visible portions 5261, 5262, 5263 and concealed portions 5301, 5302, 5303 may be provided. Additionally, two movable elements 5244, 5245 having only concealed portions 5304, 5305 may be provided.

The visible portions may include slots into which a key may be inserted, or may be provided with a key in place of the slot, the key providing a grip for the user to translate the respective movable element. Movable elements 5241, 5242 may further include tabs that, in the initial positions of movable elements 5241, 5242 may be positioned in slots of movable element 5243, thereby impeding the movement thereof. Furthermore, movable elements 5244, 5245 may include tabs that, in the initial positions of movable elements 5244, 5245, may be positioned in slots of movable elements 5241, 5242 thereby impeding the movement thereof.

Figure 5A:
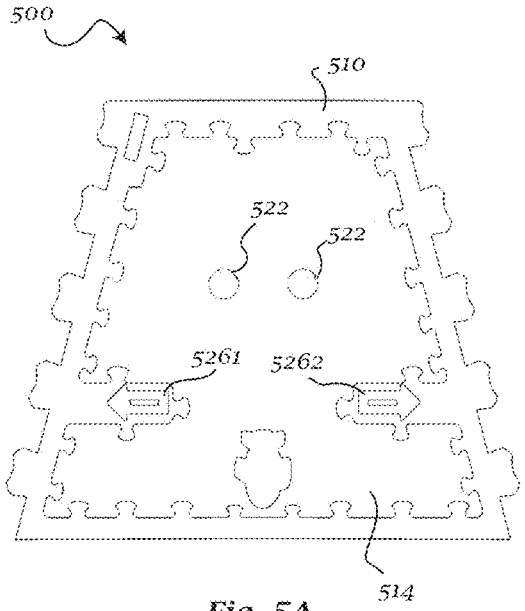
FIGS. 5A-5D show another exemplary embodiment of a puzzle box.
Figure 5B:
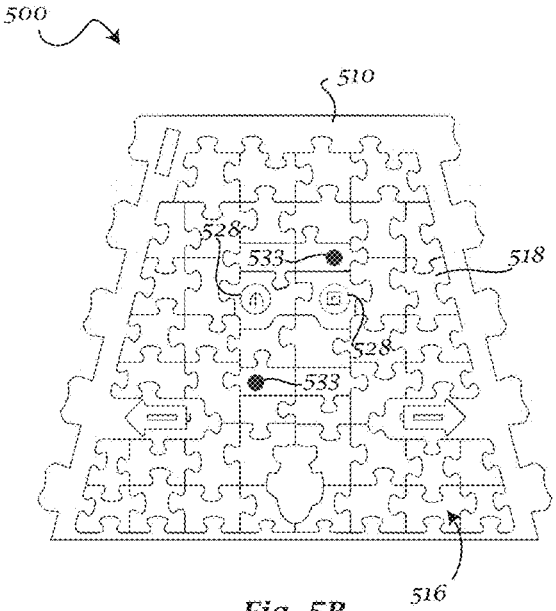
Figure 5C:
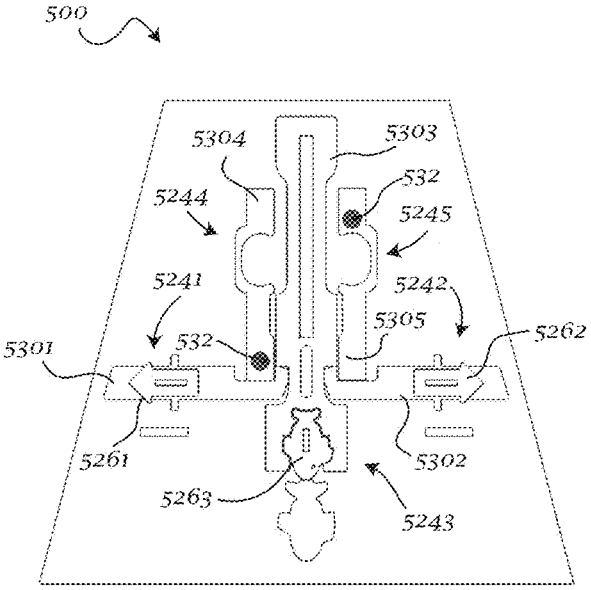
Figure 5D:
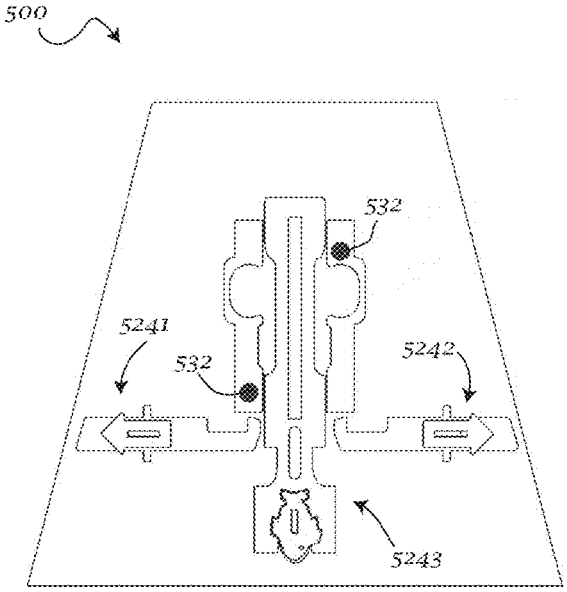

Movable elements 5244, 5245 may further include magnets 532 or components susceptible to the influence of magnets disposed in certain portions thereof. Certain puzzle pieces 518 of assemblable puzzle 516 may also include complementary magnets 533 or components susceptible to the influence of magnets disposed therein. When puzzle 516 is in a solved configuration, magnets 532 may interact with complementary magnets 533 (or the magnetically-sensitive components) so as provide an inducement for movable elements 5244, 5245 to move into their final positions. As shown in FIG. 5D, when movable elements 5244, 5245 are in their final positions, the tabs thereof may be withdrawn from slots of movable elements 5241, 5242, allowing for the movement thereof. When movable elements 5241, 5242, in turn, are moved by the user into their final positions, the tabs thereof may be withdrawn from slots of movable element 5243, allowing for the movement thereof into its final position.

Additionally, windows 528 may be defined by the arrangement of puzzle pieces when the assemblable puzzle is in the solved configuration. These windows 528 may correspond to apertures 522 provided in underlying base 514. Indicia may be provided, for example, on movable elements 5244, 5245 or on structures beneath the movable elements. When movable elements 5244, 5245 are translated into the final position, the indicia may be visible through windows 528.

FIGS. 6A-6D show another exemplary embodiment of a puzzle box 600. In the embodiment of FIGS. 6A-6D, a movable element 6241 having a visible portion 6261 and a concealed portion 6301 may be provided. Additionally, three movable elements 6242, 6243, 6244 having only concealed portions may be provided.

Movable element 6242 may include a tab that, in the initial position of movable element 6242, may be positioned in a slot of movable element 6243, thereby impeding the movement thereof. Movable element 6243, in turn, may include a tab that, in the initial position of movable element 6243, may be positioned in a slot of movable element 6244, thereby impeding the movement thereof. Notably, the tabs and slots of said movable elements may be defined and positioned such that movable elements 6242, 6243, 6244 must be moved in a particular order. For example, in the embodiment shown in FIGS. 6A-6D, movable element 6244 cannot be moved unless movable element 6243 is disposed in its final position. Similarly, movable element 6243 cannot be moved unless movable element 6242 is disposed in its final position.

Movable elements 6242, 6243, 6244 may further include magnets 632 or components susceptible to the influence of magnets disposed in certain portions thereof. Certain puzzle pieces 618 of assemblable puzzle 616 may also include complementary magnets 633 or components susceptible to the influence of magnets disposed therein. When puzzle 616 is in a solved configuration, magnets 632 may interact with complementary magnets 633 (or the magnetically-sensitive components) so as to provide an inducement for movable elements 6242, 6243, 6244 to move into their final positions. However, in the embodiment, due to the specific order of movement of elements 6242, 6243, 6244, the corresponding puzzle pieces must likewise be placed on the underlying base 614 of frame 610 in a particular order.

Figure 6A:
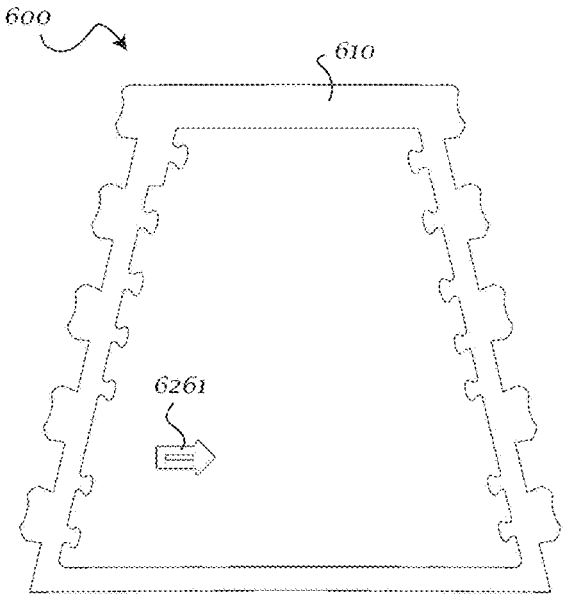
FIGS. 6A-6D show another exemplary embodiment of a puzzle box.
Figure 6B:
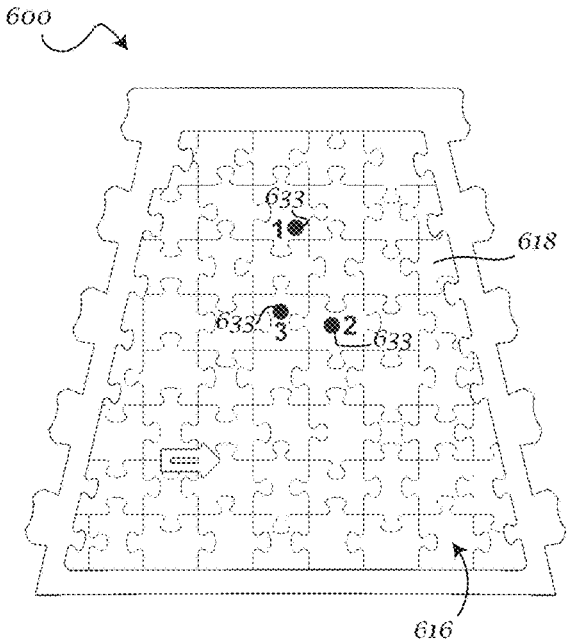
Figure 6C:
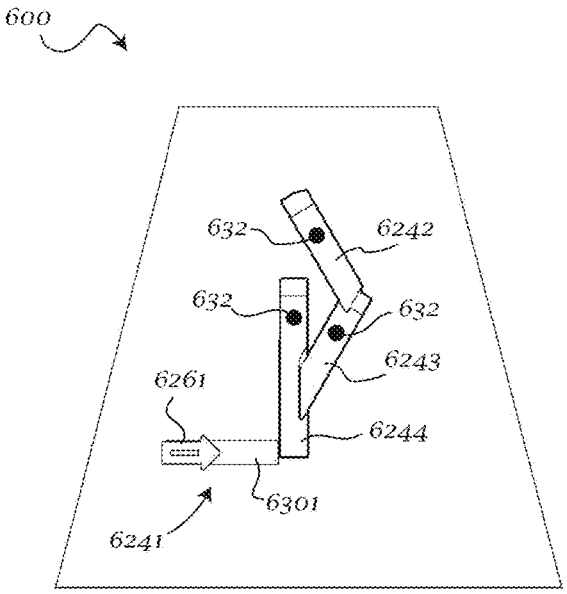
Figure 6D:
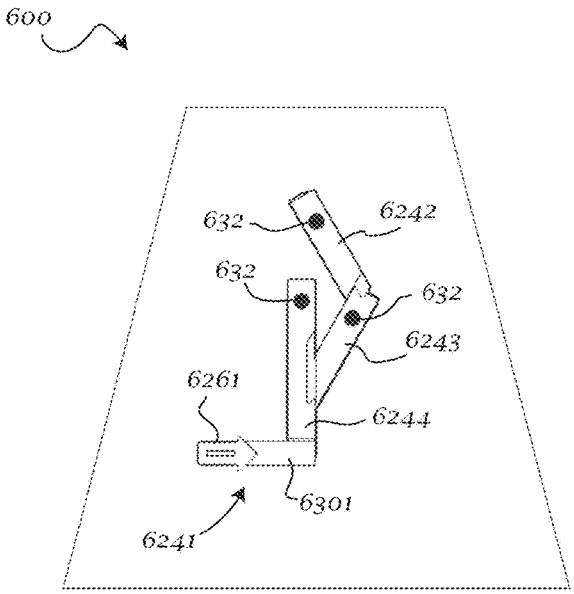
Figure 7A:
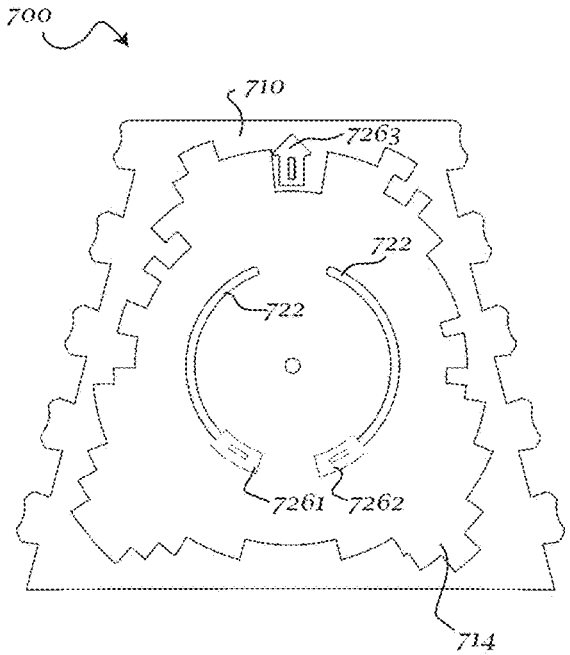
FIGS. 7A-7D show another exemplary embodiment of a puzzle box.
Figure 7B:
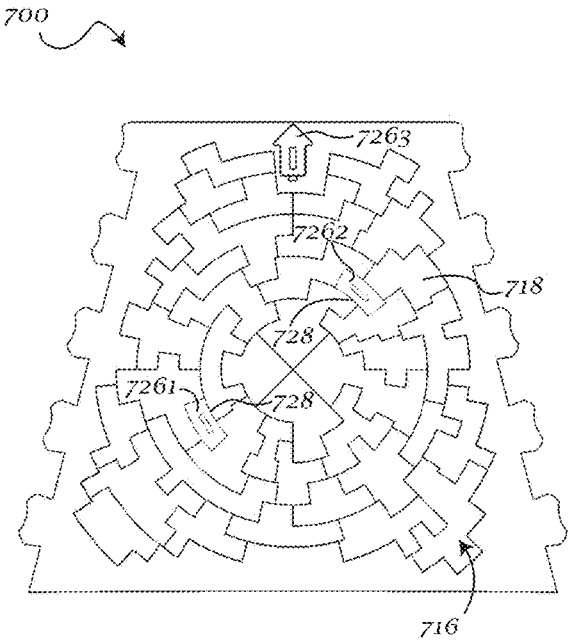
Figure 7C:
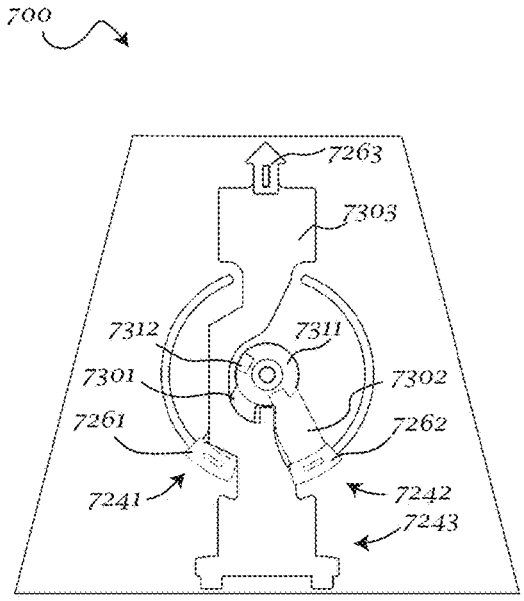
Figure 7D:
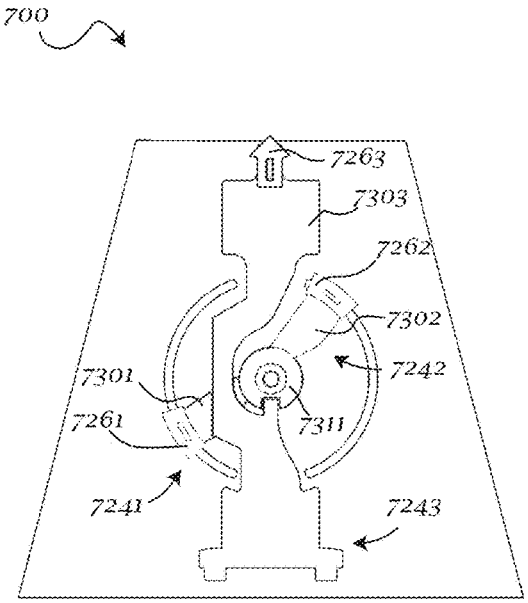
Figure 8A:
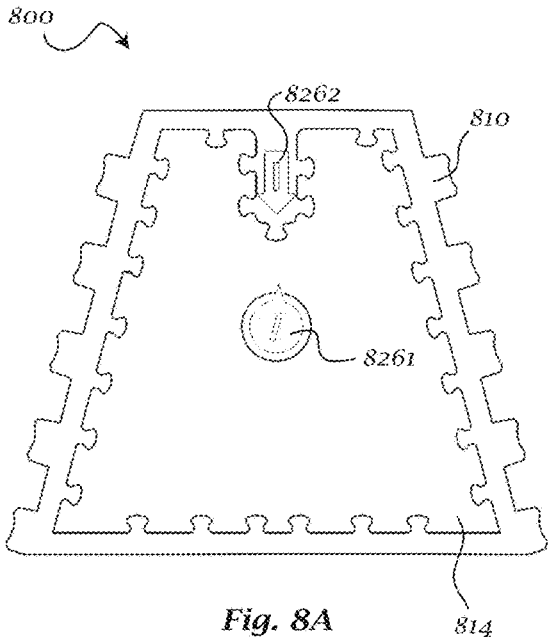
FIGS. 8A-8D show another exemplary embodiment of a puzzle box.
Figure 8B:
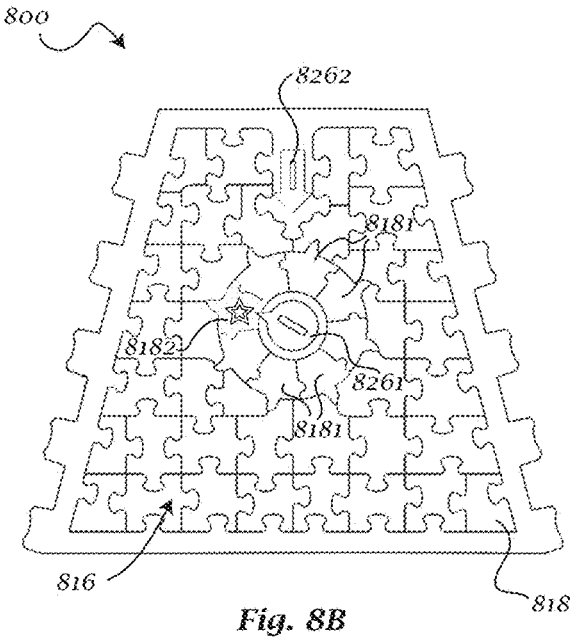
Figure 8C:
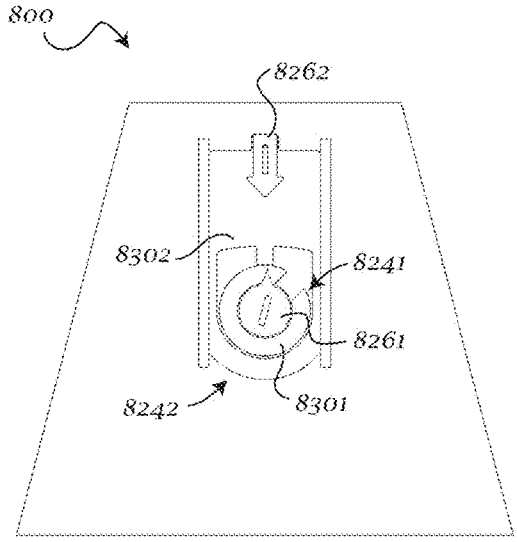
Figure 8D:
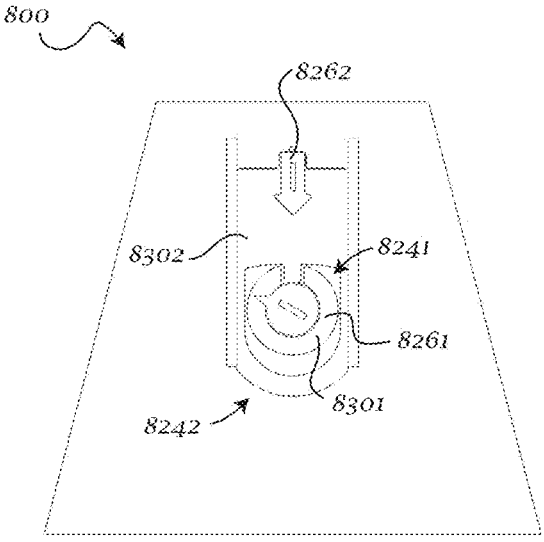
Figure 9A:
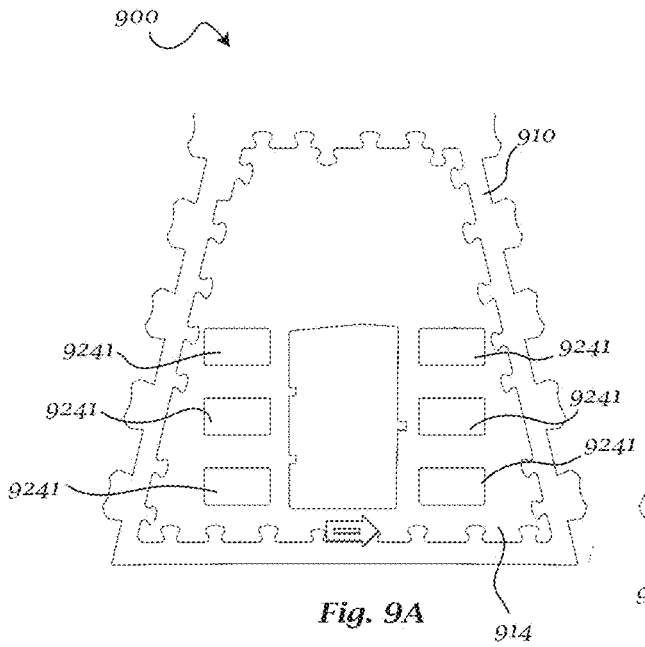
FIGS. 9A-9D show another exemplary embodiment of a puzzle box.
Figure 9B:
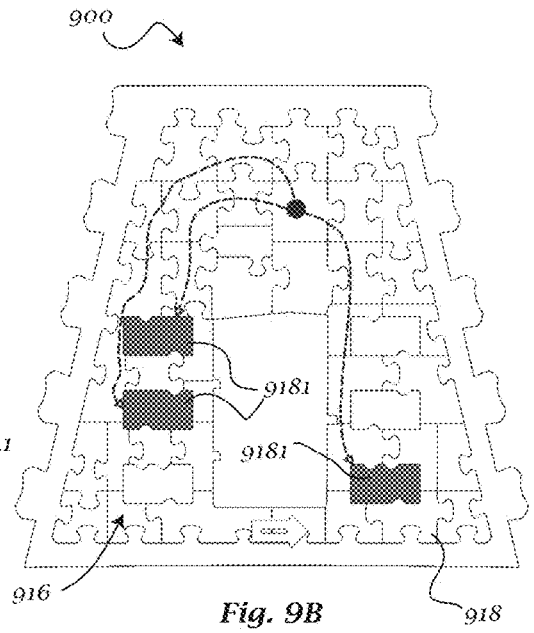
Figure 9C:
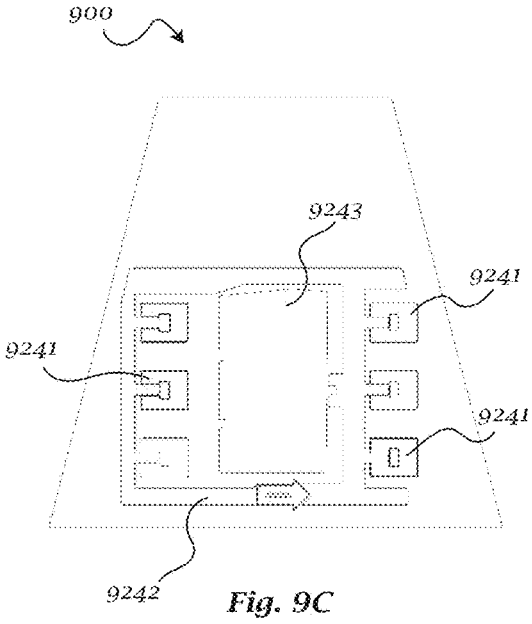
Figure 9D:
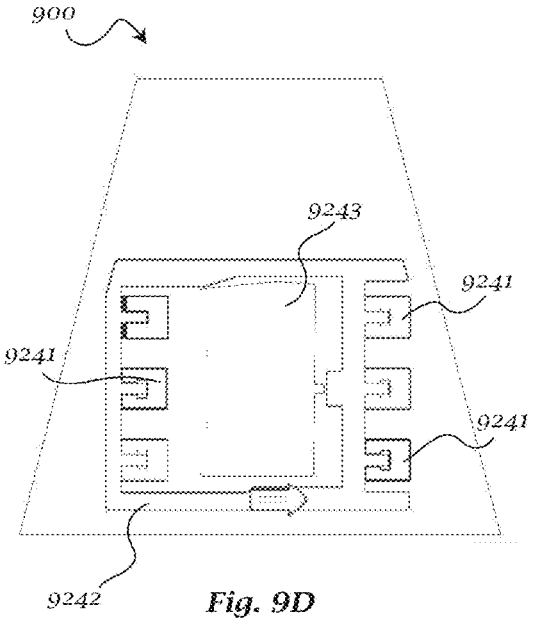
Figure 10A:
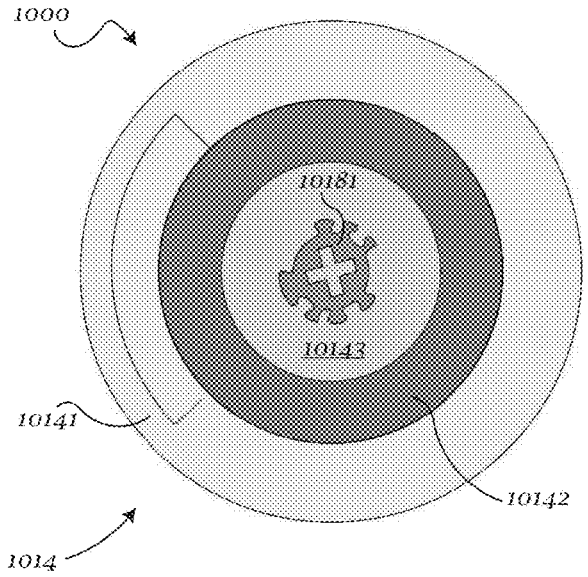
FIGS. 10A-10D show another exemplary embodiment of a puzzle box.
Figure 10B:
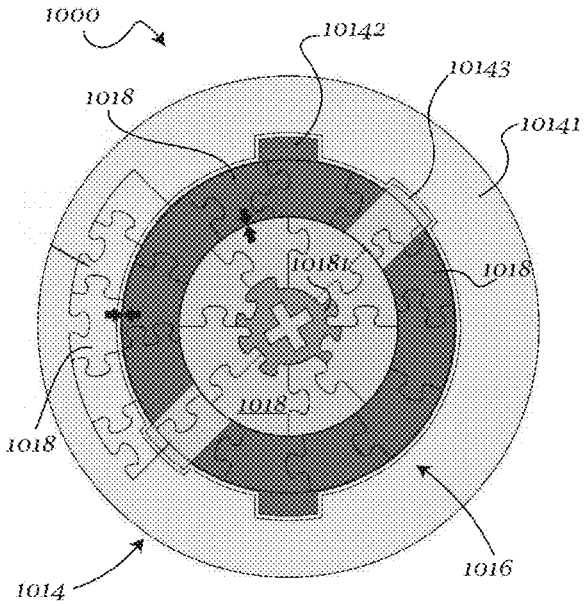
Figure 10C:
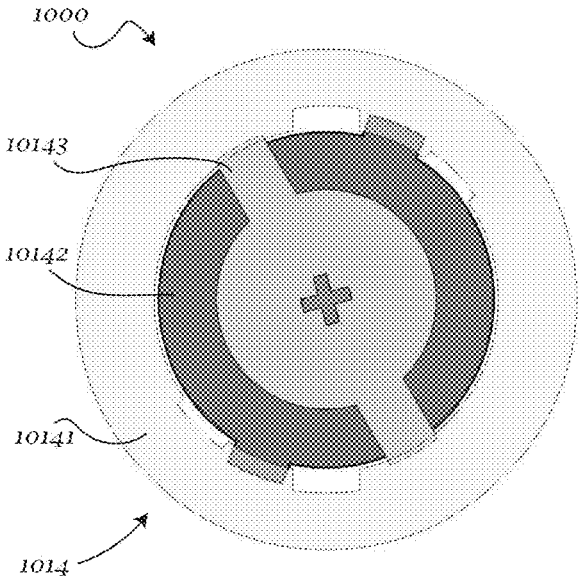
Figure 10D:
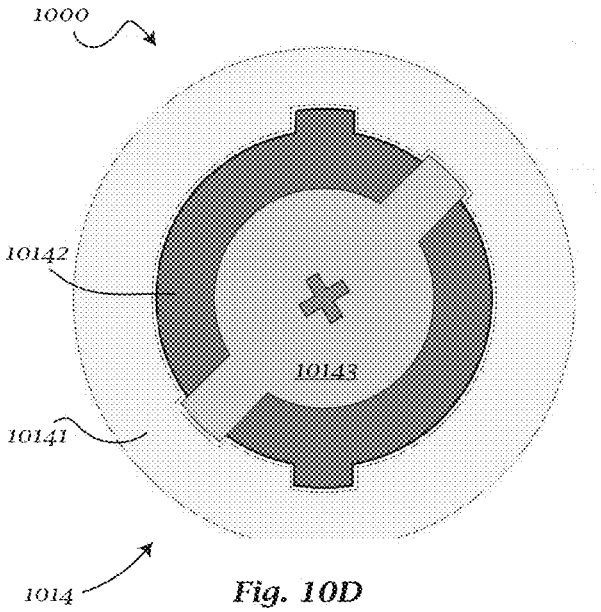
Figure 11A:
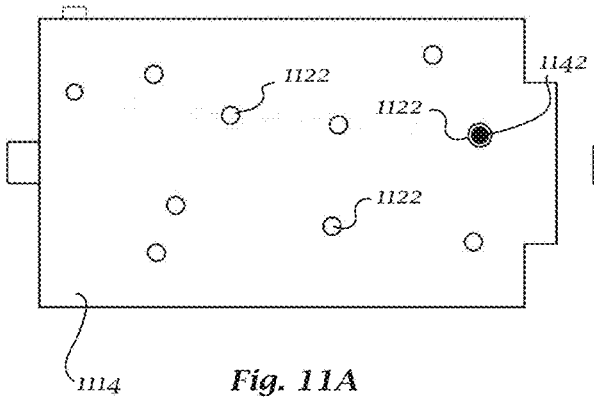
FIGS. 11A-11D show another exemplary embodiment of a puzzle box.
Figure 11B:
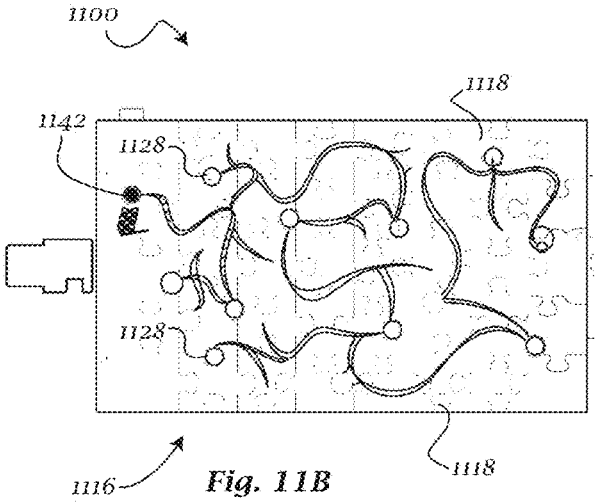
Figure 11C:
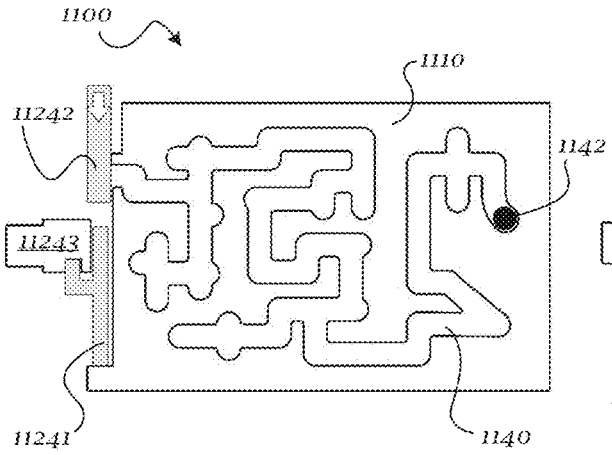
Figure 11D:
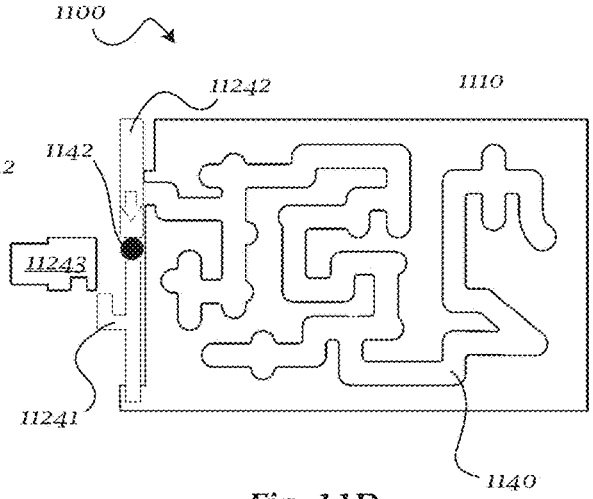

When movable elements 6242, 6243, 6244 are moved via the influence of the puzzle piece magnets into their final positions, the movement of movable element 6421 into its final position may be allowed, as shown in FIG. 6D.

FIGS. 7A-7D show another exemplary embodiment of a puzzle box 700. In the embodiment of FIGS. 7A-7D, the solved configuration of the assemblable puzzle 716 can provide guidance as to the positioning of movable elements. In the exemplary embodiment, two first movable elements 7241, 7242 having visible portions 7261, 7262, first concealed portions 7301, 7302, and second concealed portions 7311, 7312 may be provided. Additionally, a second movable element 7243 having a visible portion 7263 and concealed portion 7303 may be provided. Visible portions 7261, 7262 may include slots into which a key may be inserted, or may be provided with a key in place of the slot, the key providing a grip for the user to rotate the respective movable element.

The underlying base 714 of frame 710 can have a plurality of slits 722 defined therein, which, in the exemplary embodiment, may be arcuate. When assemblable puzzle 716 is in the solved configuration, windows 728 may be defined by the arrangement of the puzzle pieces. Windows 728 may have a size and shape that is substantially similar to visible portions 7261, 7262, and may be provided in the final positions of visible portions 7261, 7262 along slits 722. Visible portions 7261, 7262 may protrude above the surface of the underlying base 714 so as to be disposed within windows 728 when the assemblable puzzle is in the solved configuration. In other words, according to the exemplary embodiment, when the assemblable puzzle is in the solved configuration, visible portions 7261, 7262 would necessarily be disposed at their final positions by way of being positioned within windows 728.

Each of first movable elements 7241, 7242 can include a first concealed portion 7311, 7312 that may be provided as a hub, and a second concealed portion 7301, 7302 that may be provided as an arm connecting the first concealed portion and the visible portion of the corresponding moveable element. Each first concealed portion may further include a slot, while the concealed portion 7303 of second movable element 7243 may include a tab. When one or both of the first movable elements 7241, 7242 is in their initial or intermediate positions, the tab may abut the circumferences of one or both of the hubs of first concealed portions 7311, 7312, thereby preventing the movement of second movable element 7243 from its initial position. Conversely, when both movable elements 7241, 7242 are in their final positions, the tab of the second movable element may enter the slots of both first movable elements, thereby allowing for the translation of second movable element into its final position. Movement of second movable element 7243 into its final position may be a goal, or one of the goals of the above-described puzzle, and may also provide information or inducements regarding other puzzles of the puzzle box.

FIGS. 8A-8D show another exemplary embodiment of a puzzle box 800. In the embodiment of FIGS. 8A-8D, the solved configuration of the assemblable puzzle can also provide guidance as to the positioning of movable elements. In the exemplary embodiment, a first movable element 8241 having a visible portion 8261 and a concealed portion 8301 may be provided. Additionally, a second movable element 8242 having a visible portion 8262 and a concealed portion 8302 may be provided. The visible portions may include slots into which a key may be inserted, or may be provided with a key in place of the slot, the key providing a grip for the user to translate or rotate the respective movable element.

Movable element 8241 may be rotatable, with visible portion 8261 having a position indicator, while concealed portion 8301 may be provided as a hub having a slot defined therein. When the assemblable puzzle 816 is in the solved configuration, a plurality of puzzle pieces 818 may surround the visible portion 8261. The correct position of the position indicator, i.e., the final position of movable element 8241, may be shown by indicia provided on one or more of the puzzle pieces. For example, according to the embodiment, a plurality of identical puzzle pieces 8181 may surround visible portion 8241, with one of the puzzle pieces 8182 having an appearance or indicia that indicate that the position indicator should be oriented towards said puzzle piece. Of course, any other arrangement, indicia, or other factors that enable puzzle box to function as described herein may be contemplated and provided as desired.

The concealed portion 8302 of second movable element 8242 may include a tab, which may abut the circumference of the hub of concealed portion 8301 when the latter is in its initial or intermediate positions, thereby impeding the movement of second movable element 8242. Conversely, when first movable element 8241 is in its final position, the tab of the second movable element may enter the slot of the former, thereby allowing the translation of second movable element 8242 into its final position. Movement of second movable element 8242 into its final position may be a goal, or one of the goals of the above-described puzzle, and may also provide information or inducements regarding other puzzles of the puzzle box.

FIGS. 9A-9D show another exemplary embodiment of a puzzle box 900. In the embodiment of FIGS. 9A-9D, a plurality of first movable elements 9241 may have visible portions that are provided as buttons, i.e., the first movable elements may be movable in the above-beneath direction. Depressing certain of the first movable elements 9241 may provide an inducement for the translation of a second movable element 9242, which may have a visible portion and a concealed portion that interacts with portions of the first movable elements 9241.

When assemblable puzzle 916 is in the solved configuration, indicia on certain of the puzzle pieces may indicate which of the plurality of first movable elements 9241 should be pressed so as to achieve the goal, or a goal of the puzzle. For example, in the embodiment, the certain movable elements that need to be pressed may have puzzle pieces 9181 superimposed thereon. Such puzzle pieces may have a different visual appearance than other puzzle pieces, or may be indicated by other visual indicia on the puzzle as the puzzle pieces that should be pressed. Pressing the correct first movable elements 9241 and moving second movable element 9242 may result in an inducement for a movement of an additional movable element; for example, a third movable element 9243, such as a door disposed between the first movable elements, may be unlocked and opened, revealing a previously-concealed chamber or the interior of the puzzle box. A goal of the puzzle may thus be achieved. Of course, any other arrangement, indicia, or other factors that enable puzzle box to function as described herein may be contemplated and provided as desired.

FIGS. 10A-10D show another exemplary embodiment of a puzzle box 1000. In the exemplary embodiment, underlying base 1014 may include static portions 10141 and rotatable portions 10142, 10143. Rotatable portions 10142, 10143, may be rotatable with respect to each other and to static portion 10141, and may be rotatable around collinear axes. The assemblable puzzle may be assembled on the surfaces of the static and rotatable portions. Rotatable portions 10142, 10143 may further include tabs that, in the final positions of the rotatable portions, fit into slots defined in static portion 10141, allowing for the rotatable portions to be withdrawn. A puzzle piece 10181 may also be provided as a guidance element at the center of the assemblable puzzle.

In the solved configuration, the assemblable puzzle 1016 may provide an inducement for rotating the rotatable portions into their final positions. For example, visual indicia may be provided on certain puzzle pieces 1018, and may need to be aligned with indicia on certain puzzle pieces 1018 laid on different portions. By aligning the indicia, the portions may be rotated into their final positions, thereby positioning the tabs within the slots and allowing for the rotatable portions to be withdrawn, revealing a previously-concealed chamber or the interior of the puzzle box. A goal of the puzzle may thus be achieved.

FIGS. 11A-11D show another exemplary embodiment of a puzzle box 1100. In the exemplary embodiment, a labyrinth 1140 with a rolling sphere 1142 may be provided within a frame 1110 of puzzle box 1100. The underlying base 1114 for assembly of the puzzle may then be overlaid on the labyrinth, such that the labyrinth is not visible except through certain apertures 1122 defined in the underlying base.

When the assemblable puzzle 1116 is laid over the underlying base in the solved configuration, the assemblable puzzle can provide the user with guidance on moving the sphere 1142 through labyrinth 1140, for example, via visual indicia disposed on puzzle pieces 1118. Such indicia may depict a map of the labyrinth, or any may include any other guidance for solving the labyrinth that may be contemplated and provided as desired. Windows 1128, which may correspond to apertures 1122, may be defined by the arrangement of puzzle pieces 1118.

Puzzle box 1100 may further include movable elements 11241, 11242, with only element 11241 being accessible to the user. A gap may be provided between movable elements 11241, 11242, such that a movement of element 12241 does not induce a movement of element 11242. However, when sphere 1142 is moved to the end of the labyrinth, it may fill the gap between the movable elements, thereby providing an inducement for moving movable element 11242 into a final position when movable element 11241 is moved. This may also result in the movement of yet another movable element 11243 being unblocked. A goal of the puzzle may thus be achieved.

FIGS. 12A-12D show another exemplary embodiment of a puzzle box 1200. In the exemplary embodiment, a frame 1210 having an underlying base 1214 may be provided. An assemblable puzzle 1216, which may be, for example, a logical puzzle rather than a jigsaw puzzle, may include a plurality of puzzle pieces 1218, with the puzzle pieces having magnets 1232 or components susceptible to the influence of magnets disposed in certain portions thereof.

Provided beneath underlying base 1214 may be a first movable element 12241 and second movable elements 12242. The first and second movable elements may be disposed in a common plane with, and translatable within and in relation to a static element 1225. Additionally, blocking elements 1244 may be disposed between first movable element 12241 and static element 1225, and inducing elements 1245 may be disposed between first movable element 12241 and second movable elements 12242. Blocking elements 1244 and inducing elements 1245 may include magnets or components susceptible to the influence of magnets disposed therein, or may be made of magnetic or magnetically-susceptible material.

Figure 12A:
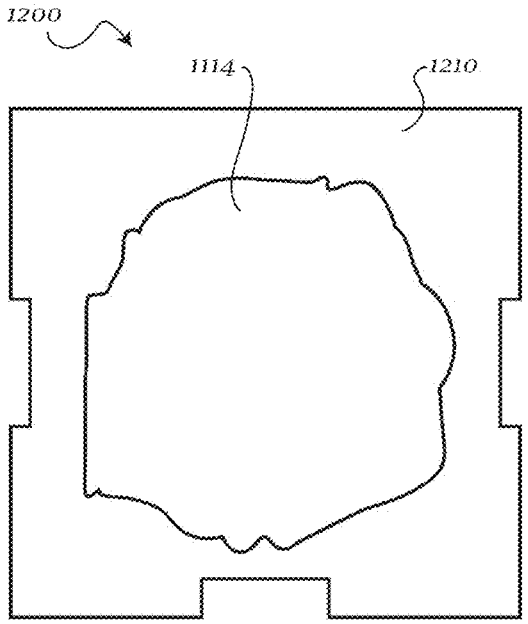
FIGS. 12A-12D show another exemplary embodiment of a puzzle box.
Figure 12B:
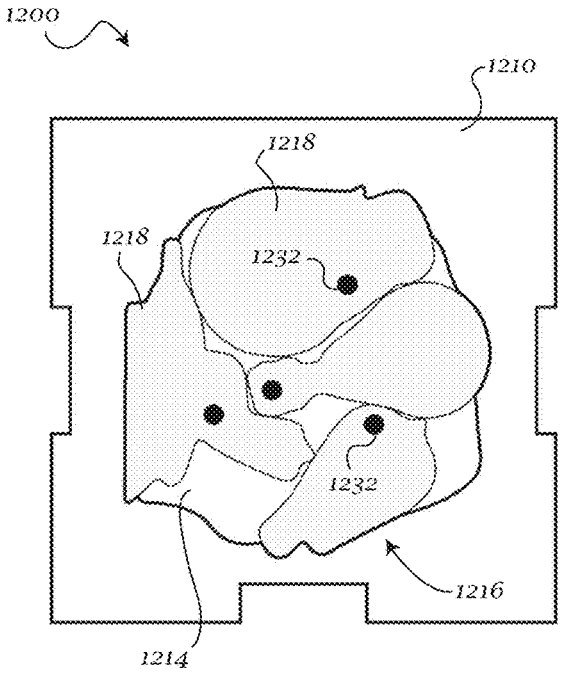
Figure 12C:
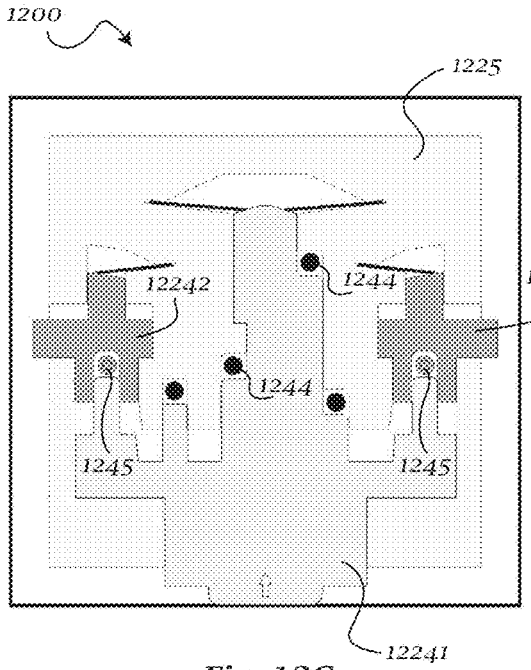

As shown in FIG. 12C, when disposed in the plane common with the movable and static elements, blocking elements 1244 may block the movement of first movable element 12241, for example by being disposed in gaps between first movable element 12241 and static element 1225. Similarly, when disposed in the plane common with the movable and static elements, inducing elements 1245 may induce a movement of second movable elements 12242 when first movable element 12241 is moved, for example by being disposed in gaps between first movable element 12241 and second movable elements 12242.

Figure 12D:
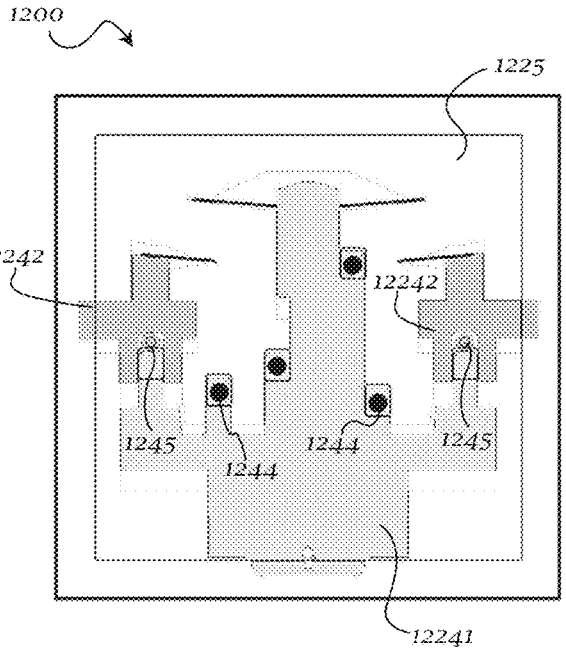

Blocking elements 1244 and inducing elements 1245 may be withdrawn from the common plane with the movable and static elements, for example by way of magnetic interaction with magnets 1232 disposed within puzzle pieces 1218. When puzzle pieces 1218 are placed in an incorrect configuration, certain of the blocking elements may be withdrawn, while certain other of the blocking elements may remain in the common plane, thereby blocking movement of first movable element 12241. Additionally, when puzzle pieces 1218 are placed in an incorrect configuration, both the blocking elements and some or all of the inducing elements may be withdrawn, thereby allowing the movement of first movable element 12241, but without inducing a movement of one or both second movable elements 12242. However, when the assemblable puzzle 1216 is in the solved configuration, the blocking elements may be withdrawn, while the movable elements may remain in the common plane, as shown in FIG. 12D. Accordingly, the movement of first movable element 12241 may be unblocked, and the movement of second movable elements 12242 may be induced in response to the movement of the first movable element. A goal of the puzzle may thus be achieved.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

Enumerated aspects of the disclosure are listed in the following.

1. A puzzle box, comprising: an assemblable puzzle, the puzzle including at least one puzzle piece; a movable element movable between an initial position and a subsequent position; wherein a configuration of the puzzle pieces of the puzzle provides an inducement for a movement of the movable element into the subsequent position.

The subsequent position may be a final position, or may be at least one intermediate position between the initial position and a final position. A goal may be achieved by solving the assemblable puzzle, moving the movable element to the final position or a combination of both; or, a step towards achieving the goal may be taken by solving the assemblable puzzle, moving the movable element to the final position, or a combination of both, as explained above.

The puzzle may include one or more puzzle pieces. For example, the puzzle may include at least two puzzle pieces. The one or more puzzle pieces may be arranged in a predetermined manner to achieve the configuration, e.g., a solved configuration, which provides the inducement for moving the movable element into the subsequent position, e.g., a final position. That is, the one or more puzzle pieces may need to be arranged in a predetermined manner with respect to each other and/or with respect to elements of a frame of the puzzle box.

The puzzle box may comprise a frame having a base for puzzle assembly, wherein the puzzle is assemblable on the base, e.g., on a surface of the base, and wherein the movable element is disposed in movable relation to the frame. The configuration, e.g., the solved configuration, of the puzzle or puzzle pieces may provide the inducement for a movement of the movable element into the subsequent position, e.g., from the initial position to the subsequent, e.g., the final, position.

The puzzle box may provide a cognitive and/or physical challenge to the user. The user may experience a particular challenge as the user has to solve the puzzle, i.e., achieve a specific configuration of the puzzle which allows for the movement of the at least one moveable element into its subsequent, or final, position and may thus allow for a goal to be achieved. Thus, the user may be incentivized to engage with the puzzle box for a relatively long time, in particular when moving the at least one moveable element into the subsequent/final position leads to achieving a specific goal, e.g., access to a hint necessary for solving a further puzzle of the puzzle box. The puzzle box may thus provide multi-level challenges, wherein not only the puzzle may be solved by correctly arranging the puzzle pieces but also a correct positioning of the one or more moveable elements shall be achieved, based on the correct solution of the puzzle.

2. The puzzle box of aspect 1, wherein the configuration is a solved configuration of the assemblable puzzle. Thus, solving the puzzle, i.e., achieving a final configuration of the puzzle pieces, may provide the inducement for a movement of the movable element into the subsequent, e.g., final, position.

3. The puzzle box of aspect 1 or 2, wherein the subsequent position of the movable element is a final position of the movable element. Thus, the configuration of the puzzle pieces may provide the inducement for a movement of the movable element into the final position.

4. The puzzle box of any one of the preceding aspects, wherein a goal of the puzzle box is achieved by the movement of the movable element into the subsequent position. A goal being achieved may, for example, mean that a hint is provided for solving another puzzle of the puzzle box, that lock is unlocked so that the puzzle box may be opened or so that another puzzle may be unlocked, as explained in detail above. Achieving such goals may provide a challenge to the user and/or may incentivize the user to keep engaging with the puzzle box.

5. The puzzle box of any one of the preceding aspects, wherein the inducement is one or more of a manual inducement and an automatic inducement. As explained above, the inducement may provide information to a user regarding the movement of the movable element. Alternatively, the inducement may be automatic in that the movement of the movable element may be carried out due to a physical or magnetic interaction between the movable element and the puzzle piece, or due to a physical or magnetic interaction between the movable element and an additional movable element.

6. The puzzle box of any one of the preceding aspects, wherein the inducement includes one or more of a physical link between the puzzle piece and the movable element and a logical link between the puzzle piece and the movable element. As explained above, the physical link between one or more of the puzzle pieces and at least one movable element may be, for example, a physical connection, a magnetic connection, or any other connection such that a movement or positioning of one or more puzzle pieces allows or results in a movement of at least one movable element. The logical link between one or more of the puzzle pieces and at least one movable element may be, for example, information provided to the user via one or more puzzle pieces regarding one or more steps to be taken so as to result in a movement of the movable element. Providing such links may provide a challenge to the user and/or may incentivize the user to keep engaging with the puzzle box.

7. The puzzle box of any one of the preceding aspects, further comprising at least one additional movable element, wherein the movement of the movable element into the subsequent position provides an additional inducement for a movement of the additional movable element into a subsequent position of the additional movable element. Thus, multiple moveable elements may be provided which interact with each other. Thereby more complex mechanisms may be achieved which may provide a challenge to the user and/or may incentivize the user to keep engaging with the puzzle box.

8. A puzzle box, comprising: a frame having a base for puzzle assembly; a puzzle comprising at least one puzzle piece and assemblable on the base; and a movable element disposed in movable relation to the frame; wherein a solved configuration of the puzzle provides an inducement for a movement of the movable element from an initial position to a final position.

9. The puzzle box of aspect 8, wherein the inducement is a manual inducement.

10. The puzzle box of aspect 8, wherein the inducement is an automatic inducement.

11. The puzzle box of aspect 8, wherein, as a result of the inducement, the movement of the movable element is executed by a user.

12. The puzzle box of aspect 11, wherein the movement of the movable element is executed due to a movement of an additional movable element from an initial position of the additional movable element.

13. The puzzle box of aspect 8, wherein the inducement provides information to a user regarding the movement of the movable element from the initial position.

14. The puzzle box of aspect 8, wherein, as a result of the inducement, the movement of the movable element is executed without additional action by a user.

15. The puzzle box of aspect 14, wherein the movement of the movable element is carried out due to a physical or magnetic interaction between the movable element and the puzzle piece, or due to a physical or magnetic interaction between the movable element and an additional movable element.

16. The puzzle box of any one of the preceding aspects, wherein: the movable element includes one or more of a visible portion and a concealed portion; the visible portion is disposed in relation to the frame so as to be visible to a user; and the concealed portion is disposed beneath a surface of the frame so as to not be visible to the user.

17. The puzzle box of aspect 16, wherein the visible portion and the concealed portion are connected via an aperture in the frame.

18. The puzzle box of aspect 16 or 17, wherein: in the solved configuration of the puzzle, the puzzle pieces define a window; and at least a portion of the visible portion of the movable element is visible through the window.

19. The puzzle box of aspect 18, wherein: said portion of the visible portion is disposed within the window; and an outer perimeter of said portion is sized and shaped to complement an inner perimeter of the window.

20. The puzzle box of any one of aspects 8 to 19, wherein the base includes at least two surfaces, a first surface of the surfaces being disposed above a second surface of the surfaces.

What is claimed is:

1. A puzzle box, comprising:

an assemblable puzzle, the assemblable puzzle including at least one puzzle piece;

at least one external surface visible to a user, on which surface the at least one puzzle piece is placeable by the user for assembly of the assemblable puzzle;

a movable element movable between an initial position and a subsequent position; and at least one additional movable element;

wherein a positioning of the puzzle piece on the surface according to a solved configuration of the assemblable puzzle provides an inducement for a movement of the movable element into the subsequent position; and wherein the movement of the movable element into the subsequent position provides an additional inducement for a movement of the additional movable element into a subsequent position of the additional movable element.

2. The puzzle box of claim 1, wherein the positioning of the puzzle piece is according to a solved configuration of the assemblable puzzle.

3. The puzzle box of claim 1, wherein the subsequent position of the movable element is a final position of the movable element.

4. The puzzle box of claim 1, wherein a goal of the puzzle box is achieved by the movement of the movable element into the subsequent position.

5. The puzzle box of claim 1, wherein the inducement is one or more of a manual inducement and an automatic inducement.

6. The puzzle box of claim 1, wherein the inducement includes one or more of a physical link between the puzzle piece and the movable element and a logical link between the puzzle piece and the movable element.

7. A puzzle box, comprising:

a frame having a base, the base providing at least one external user-facing surface for puzzle assembly thereon, the surface being visible to a user;

a puzzle comprising at least one puzzle piece and assemblable on the user-facing surface of the base;

a movable element coupled to and disposed in movable relation to the frame; and at least one additional movable element;

wherein positioning the at least one puzzle piece according to a solved configuration of the puzzle provides an inducement for a movement of the movable element from an initial position to a final position; and wherein the movement of the movable element into the subsequent position provides an additional inducement for a movement of the additional movable element into a subsequent position of the additional movable element.

8. The puzzle box of claim 7, wherein the inducement is a manual inducement.

9. The puzzle box of claim 7, wherein the inducement is an automatic inducement.

10. The puzzle box of claim 7, wherein, as a result of the inducement, the movement of the movable element is executed by a user.

11. The puzzle box of claim 10, wherein the movement of the movable element is executed due to a movement of an additional movable element from an initial position of the additional movable element.

12. The puzzle box of claim 7, wherein the inducement provides information to a user regarding the movement of the movable element from the initial position.

13. The puzzle box of claim 7, wherein, as a result of the inducement, the movement of the movable element is executed without additional action by a user.

14. The puzzle box of claim 13, wherein the movement of the movable element is executed due to a physical or magnetic interaction between the movable element and the puzzle piece, or due to a physical or magnetic interaction between the movable element and an additional movable element.

15. The puzzle box of claim 7, wherein:

the movable element includes one or more of a visible portion and a concealed portion;

the visible portion is disposed in relation to the frame so as to be visible to a user; and the concealed portion is disposed beneath a surface of the frame so as to not be visible to the user.

16. The puzzle box of claim 15, wherein the visible portion and the concealed portion are connected via an aperture in the frame.

17. The puzzle box of claim 15, wherein:

in the solved configuration of the puzzle, one or more puzzle pieces define a window; and at least a portion of the visible portion of the movable element is visible through the window.

18. The puzzle box of claim 17, wherein:

said portion of the visible portion is disposed within the window; and an outer perimeter of said portion of the visible portion is sized and shaped to complement an inner perimeter of the window.

19. The puzzle box of claim 7, wherein the base includes at least two surfaces, a first surface of the surfaces being disposed above a second surface of the surfaces.

* * * * *